US008172352B2

(12) United States Patent
Okada et al.

(10) Patent No.: US 8,172,352 B2
(45) Date of Patent: May 8, 2012

(54) PRINTING APPARATUS HAVING LINE-TYPE INK JET HEAD AND METHOD OF PRINTING IMAGES BY LINE-TYPE INK JET HEAD

(75) Inventors: Yoshiyuki Okada, Ibaraki-ken (JP); Asayo Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 527 days.

(21) Appl. No.: 12/379,401

(22) Filed: Feb. 20, 2009

(65) Prior Publication Data

US 2009/0213156 A1 Aug. 27, 2009

(30) Foreign Application Priority Data

Feb. 22, 2008 (JP) ..... P2008-042108

(51) Int. Cl.
*B41J 29/38* (2006.01)
*B41J 2/205* (2006.01)
*B41J 2/155* (2006.01)

(52) U.S. Cl. ..... 347/11; 347/5; 347/6; 347/9; 347/10; 347/12; 347/13; 347/15; 347/20; 347/40; 347/41; 347/42; 347/43; 347/54; 347/68

(58) Field of Classification Search ..... 347/11, 347/13, 15, 42
See application file for complete search history.

(56) References Cited

U.S. PATENT DOCUMENTS

| | | | | |
|---|---|---|---|---|
| 5,914,731 | A * | 6/1999 | Yano et al. | 347/9 |
| 5,917,509 | A * | 6/1999 | Becerra et al. | 347/11 |
| 6,126,263 | A * | 10/2000 | Hotomi et al. | 347/15 |
| 6,231,151 | B1 * | 5/2001 | Hotomi et al. | 347/11 |
| 6,457,794 | B1 * | 10/2002 | Tajika et al. | 347/11 |
| 2006/0139394 | A1 * | 6/2006 | Wada | 347/19 |
| 2008/0117245 | A1 * | 5/2008 | Nishimura | 347/14 |

FOREIGN PATENT DOCUMENTS

JP 08-132645 5/1996

* cited by examiner

*Primary Examiner* — Ryan Lepisto
(74) *Attorney, Agent, or Firm* — The Nath Law Group; Jerald L. Meyer; Stanley N. Protigal

(57) ABSTRACT

A printing apparatus is provided with a line-type ink jet head having a plurality of blocks on each of which a set of ink ejection elements are arranged. A drive signal generating unit is configured to generate a drive voltage signal including a prepulse to be applied to the set of the ink ejection elements for each block, based on data indicating a number of times of ejecting ink to each pixel; and a first storage unit is configured to store a drive signal adjustment value to adjust a set of a voltage value of the drive voltage signal and a width of the prepulse for each block. The drive signal generating unit generates the drive voltage signal for each block, based on the drive signal adjustment value for each block read out from the first storage unit.

8 Claims, 10 Drawing Sheets

Fig. 14

| | Max Droplets | Voltage Increment | Prepulse Width |
|---|---|---|---|
| 1st Block Adjustment Values | 7 | A1 | a1 |
| | 6 | B1 | b1 |
| | 5 | C1 | c1 |
| | 4 | D1 | d1 |
| 2nd Block Adjustment Values | 7 | A2 | a2 |
| | 6 | B2 | b2 |
| | 5 | C3 | c2 |
| | | | |
| | 4 | D5 | a6 |
| 6th Block Adjustment Values | 7 | A6 | a6 |
| | 6 | B6 | b6 |
| | 5 | C6 | c6 |
| | 4 | D6 | d6 |

Fig. 15

| Block | Voltage Increment | Prepulse Width |
|---|---|---|
| 1 | B1 | b1 |
| 2 | B2 | b2 |
| 3 | B3 | b3 |
| 4 | B4 | b4 |
| 5 | B5 | b5 |
| 6 | B6 | b6 |

PRINTING APPARATUS HAVING LINE-TYPE INK JET HEAD AND METHOD OF PRINTING IMAGES BY LINE-TYPE INK JET HEAD

BACKGROUND OF THE INVENTION

1. Field of the Invention

The present invention relates to a printing apparatus having a line-type ink jet head and a method of printing images by a line-type ink jet head.

2. Description of the Background Art

Japanese Patent Published Application No. Hei 8-132645 discloses a printing apparatus provided with a line-type ink jet head. The line-type ink jet head has a length covering the same print width as that of print sheet, and fixedly mounted on the housing of the printing apparatus. The ink jet head discharges ink to a print sheet which is transported in the direction (vertical scanning direction) perpendicular to the line direction (main scanning direction) for forming a print image on the print sheet.

FIG. 1A is a conventional line-type ink jet head comprising a plurality of head blocks 230 (six blocks in this example) arranged in the line direction. FIG. 1B is a view for explaining the configuration of the block 230 of the conventional line-type ink jet head shown in FIG. 1A, and the dot pattern of ink ejected from the nozzle units of the line-type ink jet head. Each block 230 is composed of nozzle units 240*a* and 240*b* joined together each of which is elongated in the line direction and provided with a number of nozzles as illustrated in FIG. 1B. These nozzles are divided into groups each of which comprises three nozzles obliquely arranged with respect to the line direction for the purpose of increasing the resolution.

As shown in FIG. 1B, the nozzle unit 240*a* and the nozzle unit 240*b* are joined with a displacement p1 in the line direction. The displacement p1 is equal to ½ of the pitch dp of the nozzle such that each nozzle of the nozzle unit 240*b* is located between adjacent nozzles of the nozzle unit 240*a* in the line direction. By this configuration, ink dots can be placed by the combination of the nozzles of the nozzle unit 240*a* and nozzle unit 240*b* at even intervals corresponding to dp/2 in order to form a uniform image with even densities.

However, since the ink jet head 220 is manufactured as an industrial good, there may be some variations among products. Because of this, there may be a block in which the distance p2 between the nozzle unit 240*a* and the nozzle unit 240*b* is smaller (as illustrated in FIG. 2A) or larger than ½ of the pitch dp of the nozzle. The nozzle pitch periodically varies in such a block 230 in the line direction. Namely, adjacent nozzles of the nozzle unit 240*a* and nozzle unit 240*b* are paired with a smaller distance therebetween, such that the distance between adjacent pairs increases.

As illustrated in FIG. 2B, the block 230 may be obliquely arranged with respect to the line direction. The nozzle pitch periodically varies in such a block 230 also in such a block 230. Namely, also in this case, adjacent nozzles of the nozzle unit 240*a* and nozzle unit 240*b* are paired with a smaller distance therebetween, such that the distance between adjacent pairs increases.

It is possible to form the block 230 by making use of a single nozzle unit 240 having two series of nozzle groups as illustrated in FIG. 2C in place of the pair of nozzle units 240*a* and 240*b* joined together. In such a case, while the uneven dot arrangement due to the misalignment between the two nozzle units 240*a* and 240*b* joined together can be removed from the block 230 shown in FIG. 2A, the uneven dot arrangement due to oblique arrangement of the block 230 cannot be avoided as illustrated in FIG. 2C.

Incidentally, the ink jet printing apparatus controls the gradation level by changing the number of droplets to be ejected for each pixel (dot) from each nozzle. For example, a lighter pixel of an image is represented by a smaller number of droplets while a darker pixel of an image is represented by a larger number of droplets. Also, the amount of ink discharged from the nozzle corresponding to one droplet is in proportion to the voltage pulse applied to the piezoelectric element of the nozzle, and can be adjusted independently for each block.

FIG. 3A is a schematic diagram for showing the differences between the print image formed by an imperfect block 230 having nozzles misaligned with periodic pitch displacements from correct positions and the print image formed by a normal block 230 having nozzles arranged in their correct positions. The upper image is a light solid image portion printed by ejecting one droplet for each pixel, and the lower image is a dark solid image portion printed by ejecting seven droplets for each pixel. The left half of each image is printed by the normal block 230, and the right half of each image is printed by the imperfect block 230.

As shown in the same figure, the light solid image portion printed by ejecting one droplet for each pixel is less affected by the uneven dot arrangement, and there is little difference in density between the print image formed by the imperfect block 230 having nozzles misaligned with periodic pitch displacements and the print image printed by the normal block 230 having nozzles arranged in their correct positions. On the other hand, the dark solid image portion printed by ejecting seven droplets for each pixel is substantially affected by the uneven dot arrangement. The density is lowered by the uneven dot arrangement as compared with that of the dark solid image printed by the normal block 230.

In order to adjust the differential density, it is thought to increase the voltage of the pulses applied to the piezoelectric elements of the block 230 having nozzles misaligned with periodic pitch displacements. However, if the voltage of the pulses is increased, the densities of images are increased whenever the images are printed by the block 230 with the uneven dot arrangement, and thereby as illustrated in FIG. 3B there is a differential density in the light solid image portion between the print image formed by the imperfect block 230 and the print image printed by the normal block 230 while the differential density in the dark solid image can be eliminated.

SUMMARY OF THE INVENTION

Taking into consideration the above circumstances, it is an object of the present invention to provide a printing apparatus with which it is possible to reduce the differential density between the image portion printed by the imperfect block having nozzles misaligned with periodic pitch displacements and the image portion printed by the normal block having nozzles arranged in their correct positions throughout the density range.

In order to accomplish the object as described above, the printing apparatus in accordance with a first aspect of the present invention is provided with a line-type ink jet head having a plurality of blocks on each of which a set of ink ejection elements are arranged. Particularly, the printing apparatus comprises: a drive signal generating unit configured to generate a drive voltage signal including a prepulse to be applied to each ink ejection element on the basis of data indicating the number of times of ejecting ink to each pixel; and a first storage unit configured to store drive signal adjustment values for each block in association with the voltage value of the drive voltage signal and the width of the prepulse, wherein the drive signal generating unit generates the drive voltage signals for each set of ink ejection elements with reference to the first storage unit by the use of the drive signal adjustment values in association with the block on which the each set of ink ejection elements are arranged.

In accordance with the present invention as described above, it is possible to reduce the density unevenness in darker image portions by adjusting the voltage value of the drive voltage signal, and reduce the density unevenness in lighter image portions by adjusting the width of the prepulse. Thereby, it is possible to reduce the differential density between the image portion printed by the imperfect block having nozzles misaligned with periodic pitch displacements and the image portion printed by the normal block having nozzles arranged in their correct positions throughout the density range.

Preferably, the drive signal adjustment values for each block are determined in accordance with the maximum number of times of ejecting ink to each pixel. This maximum number is variably determined in accordance with the type of print media. This is because the drive signal adjustment values vary depending upon the darkest density, i.e., the maximum number of droplets.

In this case, it is preferred to provide a second storage unit configured to store, as nonvolatile data, the drive signal adjustment values for each of plural values of the maximum number of times of ejecting ink, such that the first storage unit stores the drive signal adjustment values read from the second storage unit corresponding to one of the plural values of the maximum number of times to be currently used. This is because, since the adjustment values may vary from one manufactured product to another, the adjustment values must be set up and stored as nonvolatile data separately for each manufactured product before shipping.

More specifically speaking, for each block which prints an image with a lighter density than other blocks when ink is ejected repeatedly for the maximum number of times by applying the same drive voltage, the drive signal adjustment values are set up in order that the voltage value of the drive voltage signal is increased and that the width of the prepulse is reduced.

The present invention is particularly effective in the case where the block comprises two units joined together in order that the ink ejection elements thereof are arranged in the line direction. This is because, when there are periodic displacements of the ink ejection elements of a block in the line direction due to the misalignments in joining the two units, the print density tends to be lowered in the image printed by the block when ink is ejected repeatedly for the maximum number of times, and the lowered print density can be appropriately adjusted by the present invention. Furthermore, the present invention is particularly effective in the case where the block comprises a single unit on which two series of the ink ejection elements thereof are arranged in the line direction.

In accordance with a second aspect of the present invention, a method is provided for performing a print process by a printing apparatus provided with a line-type ink jet head having a plurality of blocks on each of which a set of ink ejection elements are arranged, the ejection elements being driven by a drive voltage signal including a prepulse on the basis of data indicating the number of times of ejecting ink to each pixel. Particularly, the method comprises: a step of storing drive signal adjustment values for each block in association with the voltage value of the drive voltage signal and the width of the prepulse; and a step of generating the drive voltage signals for each set of ink ejection elements by the use of the drive signal adjustment values in association with the block on which the each set of ink ejection elements are arranged.

BRIEF DESCRIPTION OF THE DRAWINGS

The objects and features of the present invention will become more apparent from consideration of the following detailed description taken in conjunction with the accompanying drawings in which:

FIG. 14 is a table for showing examples of adjustment values stored in an adjustment value storing unit 170 in accordance with the embodiment of the present invention.

FIG. 15 is a table for showing is a schematic diagram for showing examples of the adjustment values stored in a register set 212 in accordance with the embodiment of the present invention.

DESCRIPTION OF THE PREFERRED EMBODIMENTS

Figure 4:
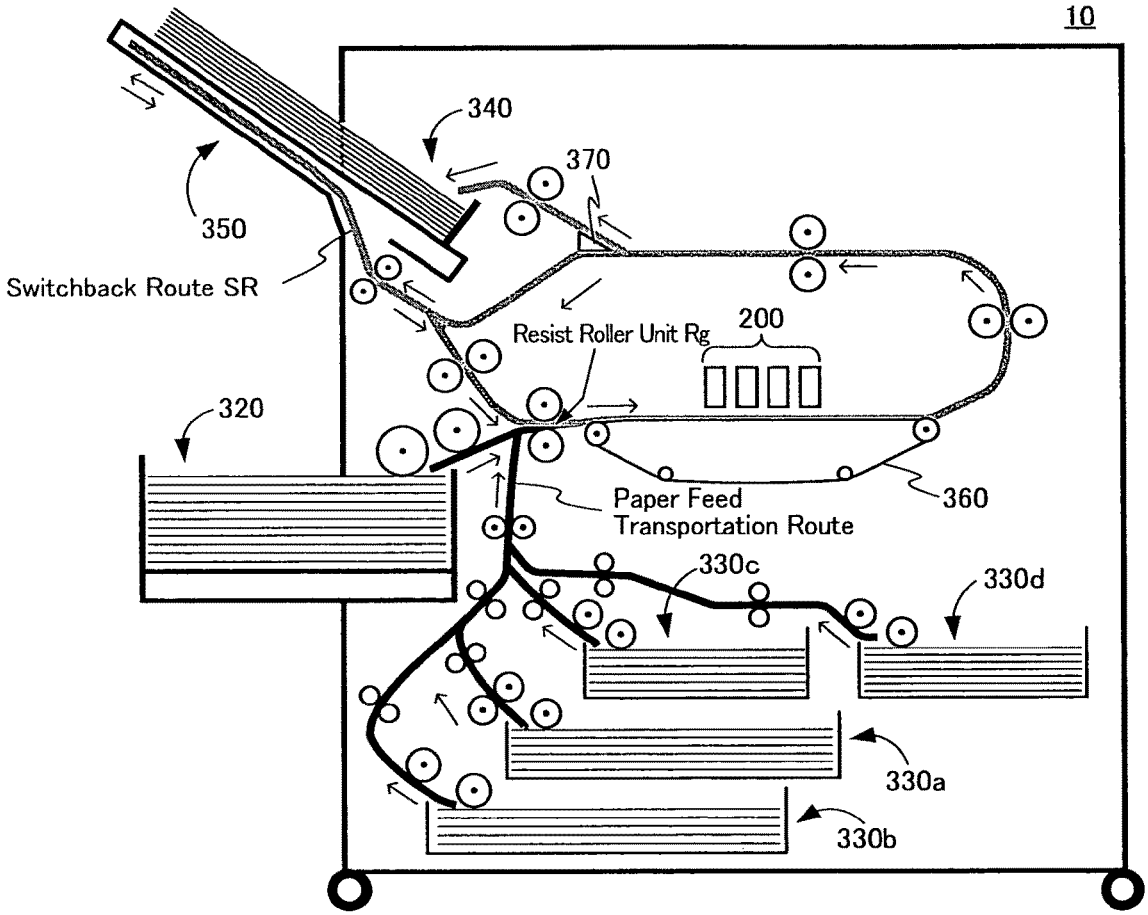
FIG. 4 is a schematic diagram for showing an ink jet printer 10 provided with a circulation transportation route in accordance with an embodiment of the present invention.

In the following description, an embodiment of the present invention will be explained in conjunction with the accompanying drawings. FIG. 4 is a schematic diagram for showing an ink jet printer 10 provided with a circulation transportation route in accordance with the present invention. Particularly, this figure shows the circulation transportation route as a print sheet circulation transportation route. As shown in the same figure, the ink jet printer 10 is provided with a paper feed mechanism for feeding print sheets including a paper feed side tray 320 exposed from the side surface of the housing of the ink jet printer 10, a plurality of paper feed trays 330*a*, 330*b*, 330*c* and 330*d* which are located inside the housing. Furthermore, a discharge port 340 is provided as a discharge mechanism for discharging print sheets which have been printed.

The ink jet printer 10 is a line color inkjet printer provided with a plurality of ink jet heads as a print mechanism which is elongated in the direction perpendicular to the paper transportation direction, each of inkjet heads 130 serves to eject black or color inks respectively in order to print images of the respective colors on a line-by-line basis. However, the present invention is not limited to a line inkjet printer, but also applicable to other types of printing apparatuses such as a serial color printer capable of forming images by scanning in the line direction.

The print sheet fed from either the paper feed side tray 320 or one of the paper feed trays 330 is transported one after another along a paper feed transportation route (black thick line) by a transportation mechanism such as roller units to a resist roller unit Rg. The resist roller unit Rg is composed of a pair of rollers and provided for defining a reference position at which the leading edge of each print sheet is aligned and oriented. The print sheet which is fed is stopped at the resist roller unit Rg for a short time, and then transferred in the direction toward the print mechanism with a predetermined timing.

There are the plurality of head units 200 on the transfer direction side of the resist roller unit Rg. The print sheet is printed to form an image with ink ejected from the ink jet heads 220 of the respective head units 200 on a line-by-line basis, while being transported at a predetermined speed in accordance with the printer option settings on a conveyor endless belt 360 which is located on the opposite side to the head units 200.

The print sheet which has been printed is further transported in the housing by the transportation mechanism such as roller units. In the case of one-side printing for printing only one side of the print sheet, the print sheet is transferred directly to the discharge port 340 and stacked on a catch tray 350 as a receiver at the discharge port 340 with the printed side down. The catch tray 350 is provided to protrude from the housing with a certain thickness. The catch tray 350 is slanted with a lower upright wall at which print sheets discharged from the discharge port 340 are automatically aligned under their own weight.

In the case of double-side printing for printing both sides of the print sheet, the print sheet is not transferred to the discharge port 340 just after printing the main side (the first printed side is called "main side", and the next printed side is called "back side" in this description), but is transported again in the housing. Because of this, the ink jet printer 10 is provided with a shunt mechanism 370 for selectively switching the transfer route for printing on the back side. After printing on the main side, the shunt mechanism 370 transfers the print sheet to a switchback route SR such that the print sheet is reversed with respect to the transportation route by the switchback operation. The print sheet is transferred to the resist roller unit Rg again by the transportation mechanism such as roller units, and stopped for a short time. Thereafter, the print sheet is transported to the print mechanism with a predetermined timing, and printed on the back side in the same manner as on the main side. After printing on the back side, the print sheet with images printed on the both sides is transferred to the discharge port 340, and stacked on the catch tray 350 serving as the receiver at the discharge port 340.

In the ink jet printer 10, the switchback operation is performed in the double-side printing mode by the use of the space formed in the lower portion of the catch tray 350. The space formed in the catch tray 350 is designed such that the print sheet cannot be accessed externally during the switchback operation. By this configuration, it is avoided that a user extracts the print sheet during the switchback operation by mistake. On the other hand, since the catch tray 350 is indispensable for the ink jet printer 10, there is no need for a separate space, which would be particularly provided in the ink jet printer 10 for the switchback operation, while making use of the space in the catch tray 350 for enabling the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

Figure 5:
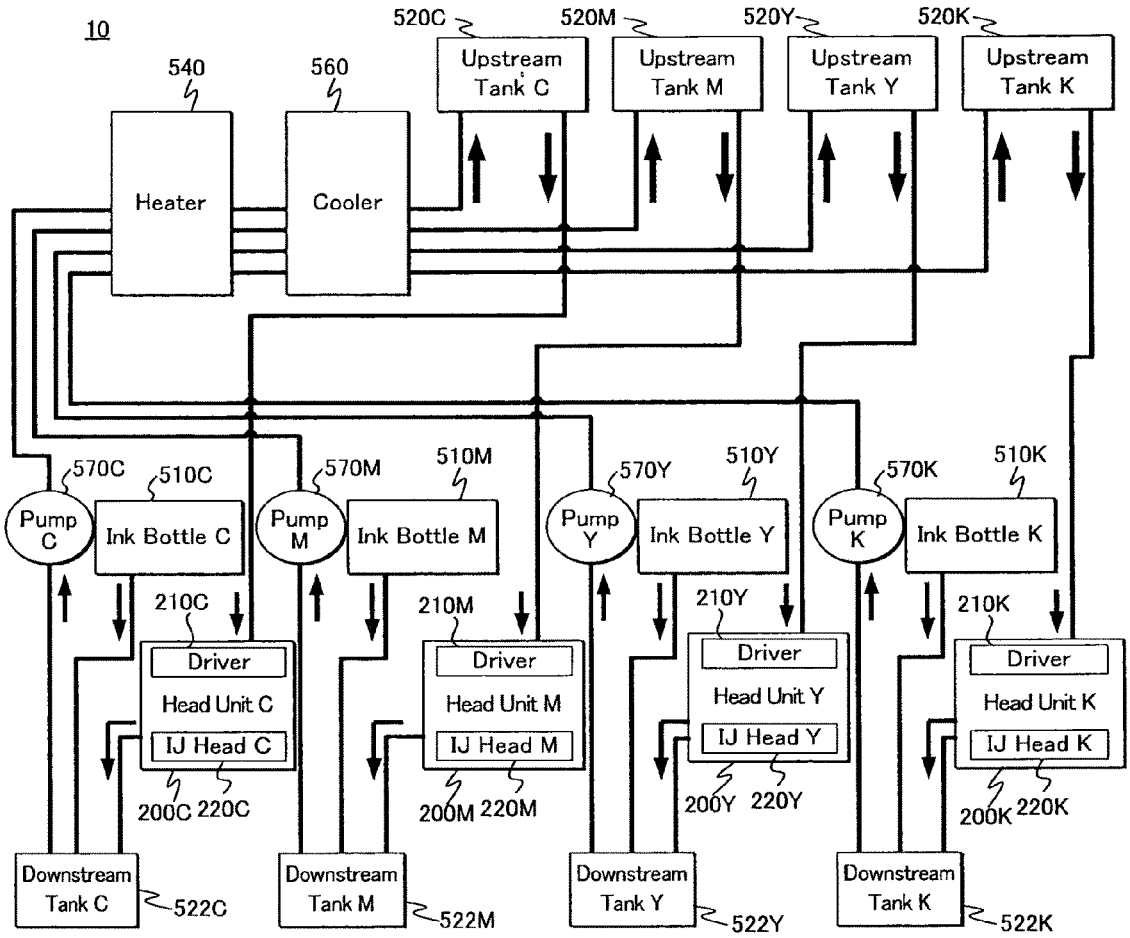
FIG. 5 is a block diagram for explaining the configuration of the ink flow paths in the ink jet printer 10 in accordance with the embodiment of the present invention.

FIG. 5 is a block diagram for explaining the configuration of the ink flow paths in the ink jet printer 10. As shown in the same figure, the ink jet printer 10 is a color printer capable of printing by the use of four color inks C, M, Y and K. The inks of the respective colors are supplied from detachable ink bottles, i.e., an ink bottle 510C for supplying cyan ink, an ink bottle 510M for supplying magenta ink, an ink bottle 510Y for supplying yellow ink, and an ink bottle 510K for supplying black ink. In this description, each of these ink bottles is generally referred to simply as the ink bottle 510.

The ink which is supplied from the ink bottle 510 is passed through the flow path formed by a resin or metallic pipe, and stored for a certain period of time in a downstream tank which is located on the downstream side of the head unit 200. Namely, the ink jet printer 10 is provided with a downstream tank 522C for storing the cyan ink, a downstream tank 522M for storing the magenta ink, a downstream tank 522Y for storing the yellow ink, and a downstream tank 522K for storing the black ink. In this description, each of these downstream tanks is generally referred to simply as the downstream tank 522.

The ink stored in the downstream tank 522 is transferred to an upstream tank on the upstream side of the head unit 200 by a pump 570. Namely, the ink jet printer 10 is provided with a pump 570C for moving the cyan ink, a pump 570M for moving the magenta ink, a pump 570Y for moving the yellow ink, and a pump 570K for moving the black ink. In this description, each of these pumps is generally referred to simply as the pump 570. Also, the ink jet printer 10 is provided with an upstream tank 520C for storing the cyan ink, an upstream tank 520M for storing the magenta ink, an upstream tank 520Y for storing the yellow ink, and an upstream tank 520K for storing the black ink. In this description, each of these upstream tanks is generally referred to simply as the upstream tank 520. The ink stored in the upstream tank 520 is transferred to the ink jet heads provided with a number of nozzles which eject droplets of ink for printing. As shown in this figure, the ink jet printer 10 includes an ink jet head 220C for ejecting the cyan ink, an ink jet head 220M for ejecting the magenta ink, an ink jet head 220Y for ejecting the yellow ink, and an ink jet head 220K for ejecting the black ink. In this description, each of these head units is generally referred to simply as the ink jet head 220. In the case of the present embodiment, it is assumed that the ink jet head 200 ejects droplets of ink by the use of piezoelectric elements.

The head unit 200 is provided with a head driver 210 (210C, 210M, 210Y or 210K) for driving the piezoelectric elements on the basis of image data. Incidentally, the ink jet printer 10 employs an ink circulation system such that the ink remaining in the ink jet heads 220 after the print process is returned to the downstream tank 522 through an ink circulation route. The water head difference between the upstream tank 520 and the downstream tank 522 is used to return the ink to the downstream tank 522 from the upstream tank 520 through the ink jet heads 220.

A warranty temperature range is defined to ensure print quality. When the ink temperature falls below this warranty temperature range, the ink has to be heated. Because of this, there is a heater 540 on the ink flow path. On the other hand, the head driver 210 and the piezoelectric elements generate heat during operation. If the ink temperature rises too high due to heat generation, such as Joule heat and the heat associated with ink vibration, the ink has to be cooled. A cooler 560 is provided for cooling the ink in order not to affect the print process by the generated heat. The ink is passed through the heater 540 and the cooler 560 for controlling the temperature, and then transferred to the upstream tank 520.

Figure 6:
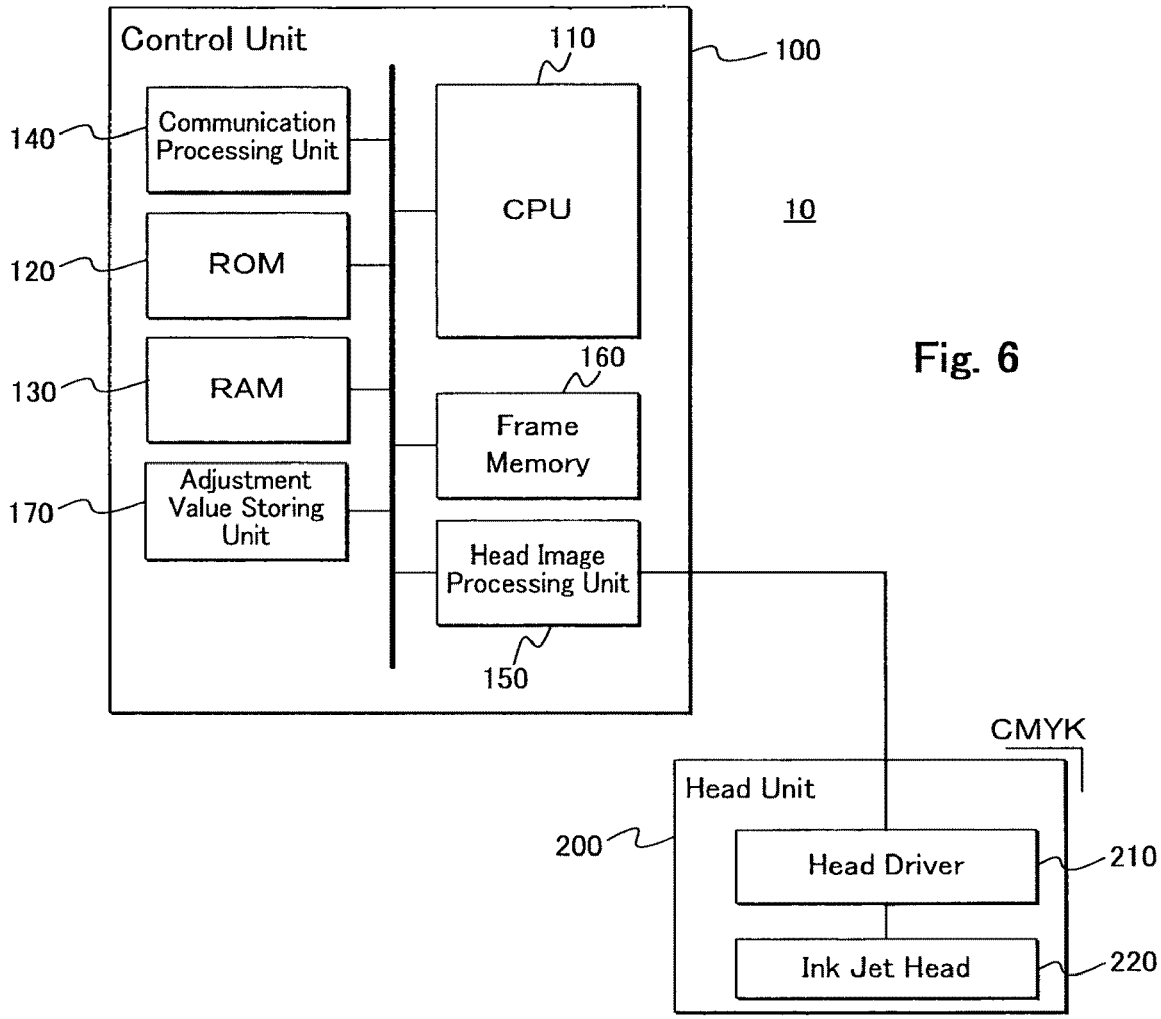
FIG. 6 is a block diagram showing part of the main elements for performing the image forming process of the line-type ink jet printer 10 in accordance with the embodiment of the present invention.

FIG. 6 is a block diagram showing part of the main elements for performing the image forming process of the line-type ink jet printer 10 to which the present invention is applied. As shown in the same figure, the ink jet printer 10 is provided with a control unit 100 and a head unit 200.

The control unit 100 is a functional unit of the ink jet printer 10 serving to perform a variety of processes, and provided with a CPU 110, a ROM 120, a RAM 130, a communication processing unit 140, a head image processing unit 150, a frame memory 160 and an adjustment value storing unit 170. In this case, the communication processing unit 140 is a processing unit for communicating with an external device and the like, for example, receiving print data from a host computer connected to the ink jet printer 10. The head image processing unit 150 is connected to the head unit 200, generates image data on the frame memory 160 on the basis of the print data, and outputs the image data to the head unit 200. The adjustment value storing unit 170 can be implemented with an EEPROM, and serves to store adjustment values which are used to control the head unit 200, and prepared individually for each manufactured product of the ink jet printer 10. Namely, the adjustment values can be set up for each manufactured product before shipping, and stored as nonvolatile data in the adjustment value storing unit 170. The information stored in the adjustment value storing unit 170 will be explained in the following description.

The head unit 200 is provided with the head driver 210 and the ink jet head 220. The head unit 200 is provided for each ink color. In the case of the present embodiment, the ink jet printer 10 is a color printer capable of printing by the use of four color inks C, M, Y and K, and the head units corresponding to the four color inks C, M, Y and K respectively.

The ink jet head 220 ejects droplets of ink from ink chambers by the use of piezoelectric elements which can be slightly expanded or contracted by applying voltage pulses. Namely, a piezoelectric element and a nozzle function as an ink ejection mechanism in combination. The head driver 210 generates drive signals having waveforms for driving the piezoelectric elements on the basis of the image data output from the head image processing unit 150 in order to control ink ejection from each nozzle.

Figure 7:
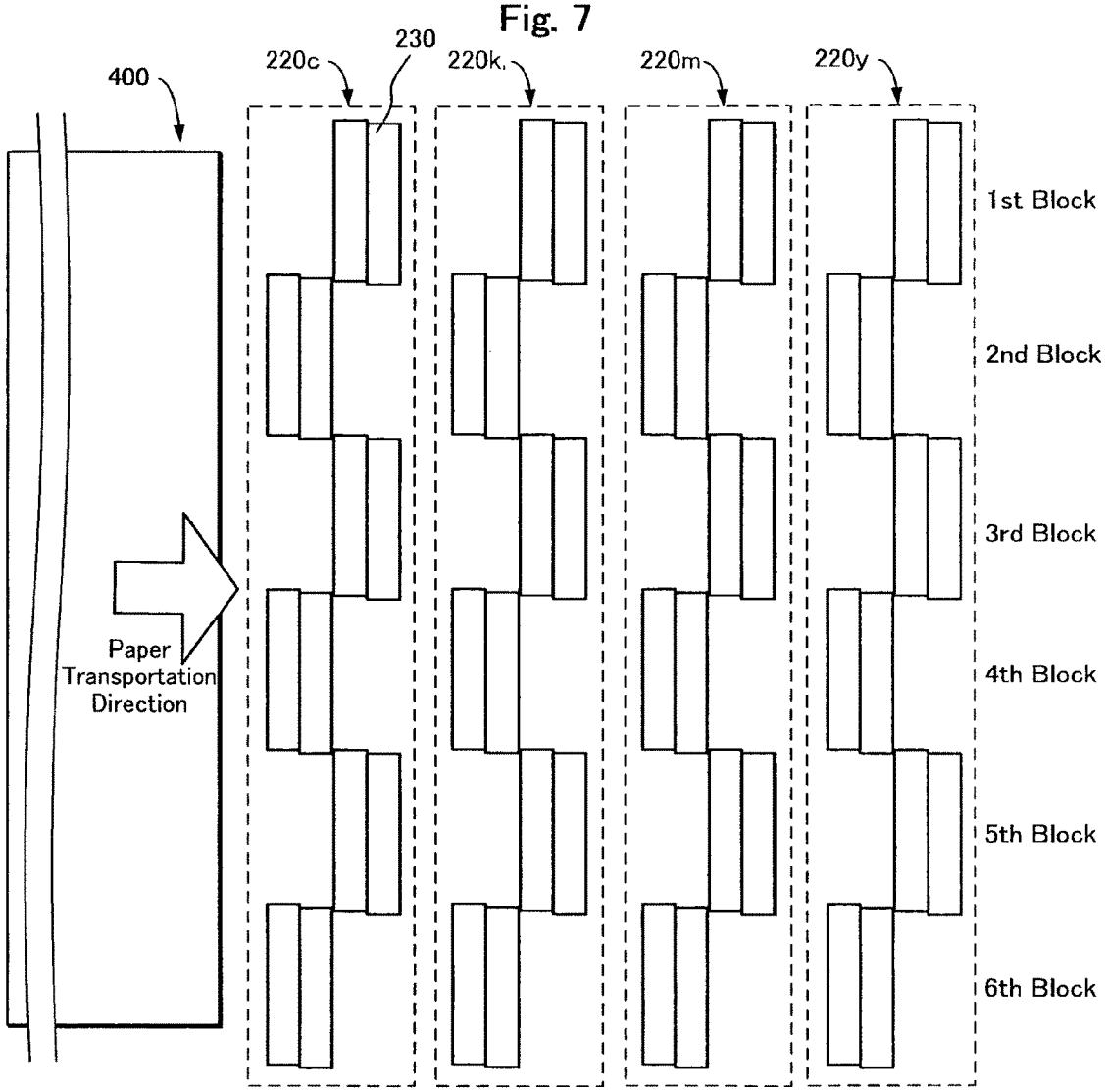
FIG. 7 is a schematic diagram for showing the arrangement of the ink jet heads in accordance with the embodiment of the present invention.

FIG. 7 is a schematic diagram for showing the arrangement of the ink jet heads. As shown in the same figure, there are the four ink jet heads 220 (220*c*, 220*k*, 220*m* and 220*y*) which are arranged in the direction of transporting a print sheet 400 and provided for discharging the four color inks C, M, Y and K. In this description, each of these ink jet heads is generally referred to simply as the ink jet head 220. Namely, the line direction is perpendicular to the direction of transporting the print sheet 400.

Figure 8A:
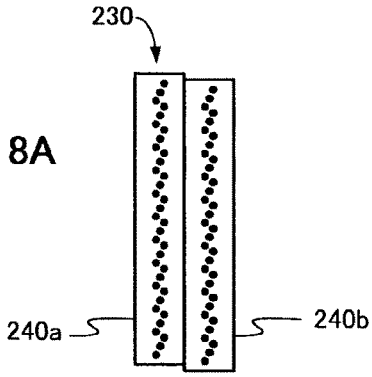
FIG. 8A is a schematic diagram for showing a block 230 comprising nozzle units 240*a* and 240*b* joined together in accordance with the embodiment of the present invention.
Figure 8B:
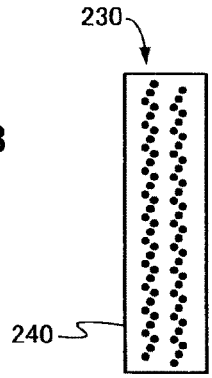
FIG. 8B is a schematic diagram for showing a block 230 comprising a single nozzle unit 240 having two series of nozzle groups in accordance with the embodiment of the present invention.

Each ink jet head 220 comprises a plurality of head blocks 230 (six blocks in this example) arranged in the line direction as illustrated in FIG. 8A. Each block 230 is composed of nozzle units 240*a* and 240*b* joined together each of which is elongated in the line direction and provided with a number of nozzles as illustrated in FIG. 8A. The nozzle units 240*a* and 240*b* are joined with a small displacement in the longitudinal direction. These nozzles are divided into groups each of which comprises three nozzles obliquely arranged with respect to the line direction for the purpose of increasing the resolution. However, it is possible to form the block 230 by making use of a single nozzle unit 240 having two series of nozzle groups as illustrated in FIG. 8B in place of the pair of nozzle units 240*a* and 240*b* joined together. In this case, the distance between the two series of nozzle groups can be designed to be smaller than in the case of the nozzle units 240*a* and 240*b* joined together shown in FIG. 8A, so that even if the block 230 is obliquely arranged with respect to the line direction, the unevenness of dot arrangement can be relatively small.

Figure 9:
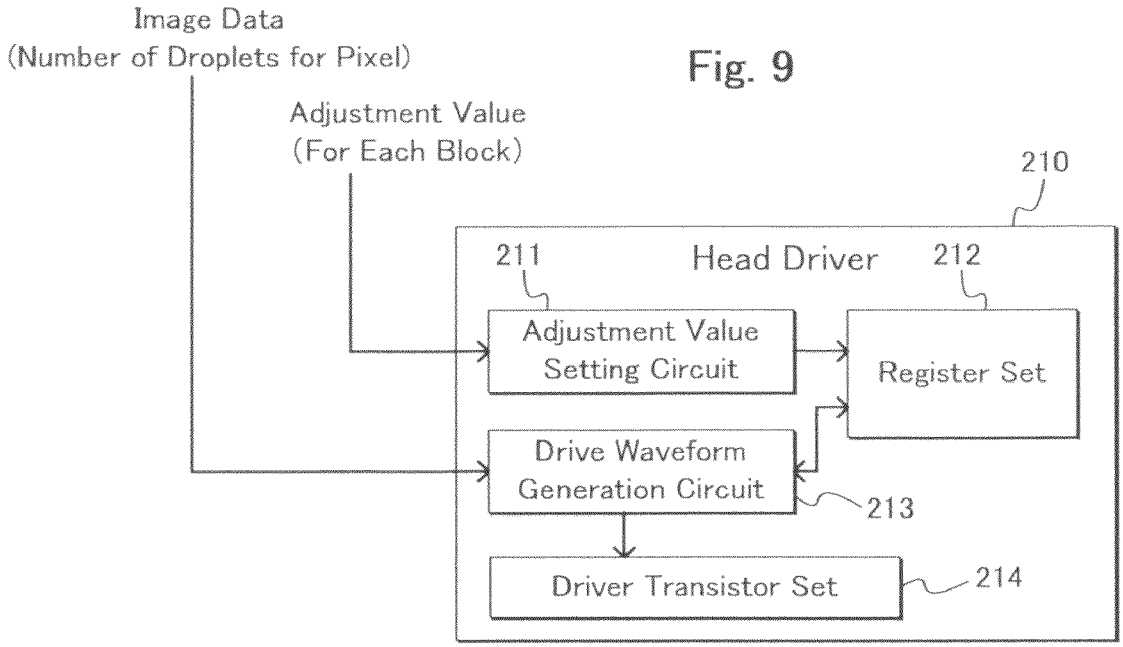
FIG. 9 is a block diagram showing the configuration of a head driver 210 in accordance with the embodiment of the present invention.

FIG. 9 is a block diagram showing the configuration of the head driver 210. As shown in the same figure, the head driver 210 is provided with an adjustment value setting circuit 211, a register set 212 a drive waveform generation circuit 213 and a driver transistor set 214. The drive waveform generation circuit 213 serves to generate drive signals having waveforms for driving the piezoelectric elements on the basis of the image data output from the head image processing unit 150, and outputs drive signals to the driver transistor set 214 in accordance with the waveforms. The driver transistor set 214 includes a set of driver transistors which are used to apply voltages to the piezoelectric elements on the basis of the drive waveforms output from the head image processing unit 150.

Incidentally, the image data output from the head image processing unit 150 is data indicative of the number of droplets to be ejected for each pixel from each nozzle. In other words, the ink jet head 220 represents a gradation level by the number of droplets, such that a lighter pixel of an image is represented by a smaller number of droplets while a darker pixel of an image is represented by a larger number of droplets. The maximum number of droplets to be ejected for a pixel is determined on the basis of the type of the print sheet, the quality of print images and so forth. The adjustment value setting circuit 211 and the register set 212 will be explained below.

Figure 1A:
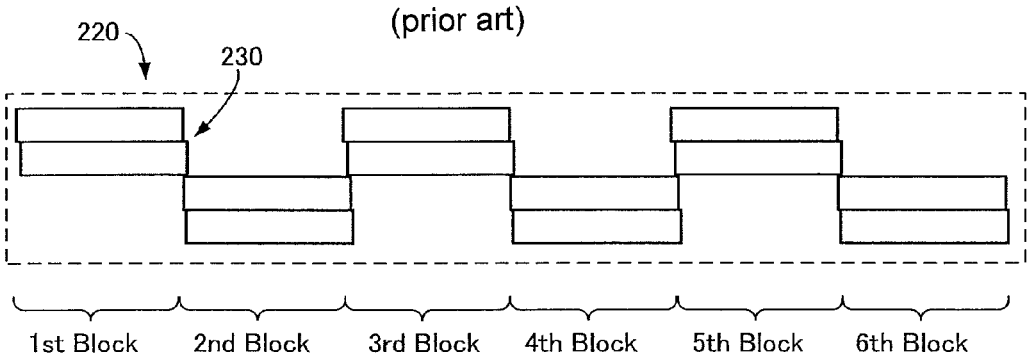
Fig. 1A (prior art)
FIG. 1A is a conventional line-type ink jet head comprising a plurality of head blocks 230 arranged in the line direction.
Figure 1B:
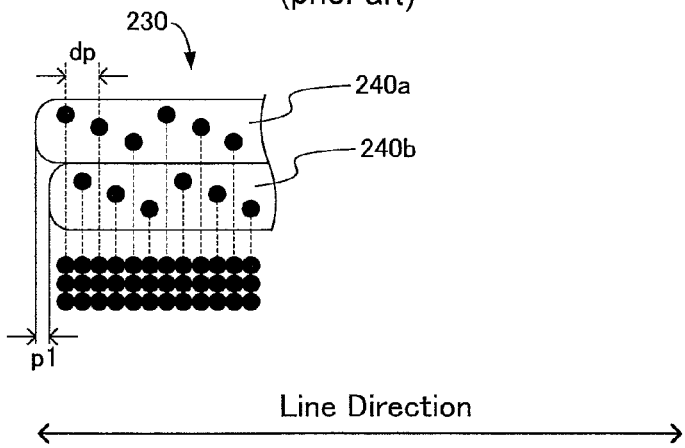
Fig. 1B (prior art)
FIG. 1B is a view for explaining nozzle units arranged in the block 230 of the conventional line-type ink jet head shown in FIG. 1A, and the dot pattern of ink ejected from the nozzle units of the line-type ink jet head.
Figure 2A:
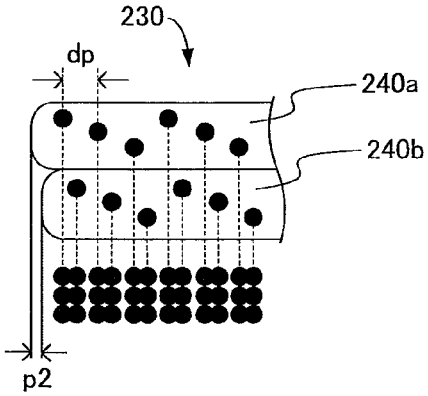
Fig. 2A (prior art)
FIG. 2A is a schematic diagram for showing one example of a block in which the distance p2 between the nozzle unit 240*a* and the nozzle unit 240*b* is not equal to the pitch dp of the nozzle.
Figure 2B:
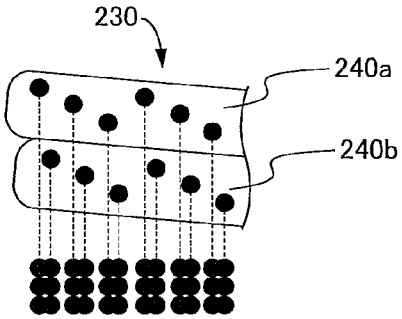
Fig. 2B (prior art)
FIG. 2B is a schematic diagram for showing the block 230 obliquely arranged with respect to the line direction.
Figure 2C:
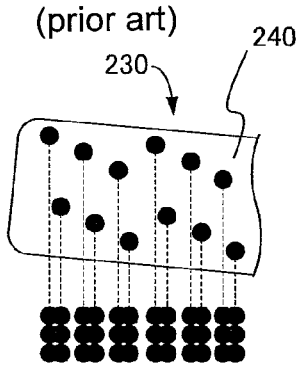
Fig. 2C (prior art)
FIG. 2C is a schematic diagram for showing an uneven dot arrangement due to oblique arrangement of the block.
Figure 3A:
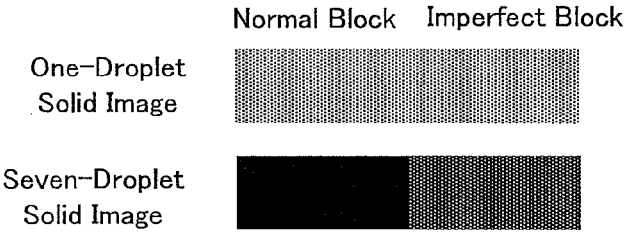
Fig. 3A (prior art)
FIG. 3A is a schematic diagram for showing the print qualities of solid images printed with one-droplet per pixel performed by an imperfect block 230 having nozzles misaligned with periodic pitch displacements and a normal block 230 having nozzles arranged in their correct positions in accordance with a conventional technique.
Figure 3B:
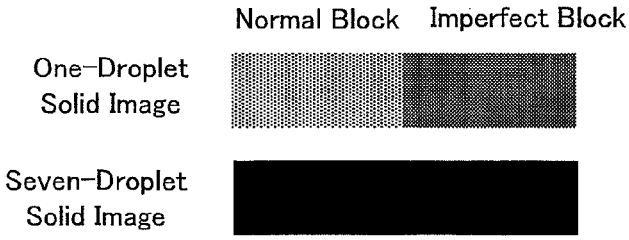
Fig. 3B (prior art)
FIG. 3B is a schematic diagram for showing the results of print process when the voltage of the pulses is increased as compared to the cases illustrated in FIG. 3A when the voltage of the pulses is not increased.

Next, the process off adjusting the amount of ink discharged from the ink jet printer 10 will be explained. As illustrated in FIG. 3A, in the case where there is a block 230 having nozzles misaligned with periodic pitch displacements from correct positions, a darker image is unevenly printed. If the voltage of the pulses is increased for such a block having nozzles misaligned with periodic pitch displacements for the purpose of the unevenness, while the density unevenness in the dark solid image can be eliminated, a lighter image portion such as an image portion comprising one-droplet pixels is unevenly printed as illustrated in FIG. 3B.

Figure 10:
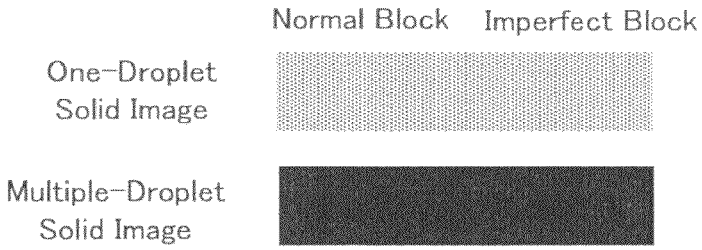
FIG. 10 is a schematic diagram for showing the results of print process performed by an imperfect block 230 having nozzles misaligned with periodic pitch displacements and a normal block 230 having nozzles arranged in their correct positions.

In the case of the present embodiment, taking into consideration the above situation, when driving the piezoelectric elements of the block having nozzles misaligned with periodic pitch displacements, the voltage of the drive signal is increased, and in addition to this the width of the prepulse is narrowed. By this configuration, the density of a lighter image portion represented by one-droplet pixels is relatively lowered so that it is possible to reduce the differential density between the image portion printed by the imperfect block 230 having nozzles misaligned with periodic pitch displacements and the image portion printed by the normal block 230 having nozzles arranged in their correct positions in both the lighter image portion represented by one-droplet pixels and the darker image portion represented by multiple-droplet pixels, as illustrated in FIG. 10.

Figure 11A:
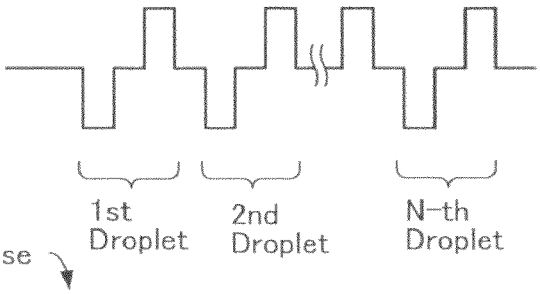
FIG. 11A is a schematic diagram for showing the pattern of the voltage pulse including no prepulse.
Figure 11B:
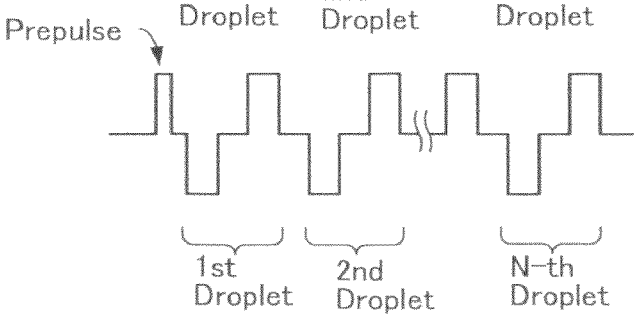
FIG. 11B is a schematic diagram for showing the pattern of the voltage pulse including a prepulse.
Figure 12:
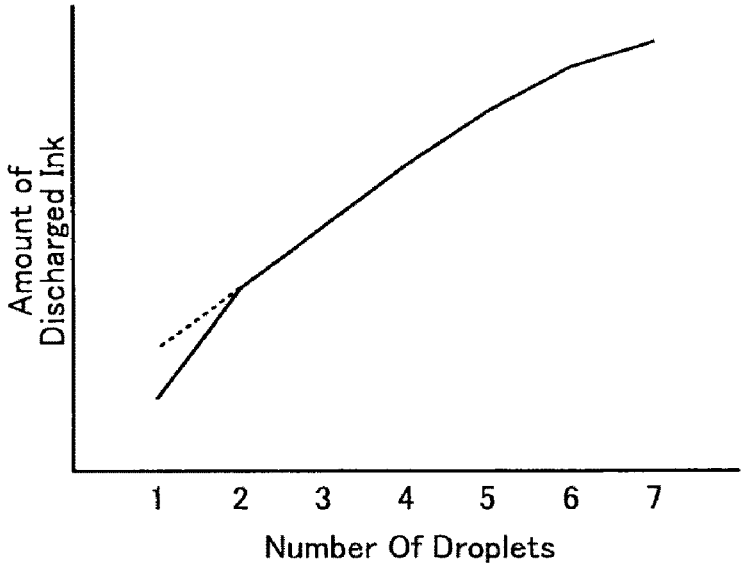
FIG. 12 is a schematic diagram for showing the relationship between the number of droplets and the ink amount.

Next, the prepulse will be explained. FIG. 11 is a schematic diagram for showing the voltage pulse applied to the piezoelectric element. Generally speaking, in the print process of the ink jet printer, one droplet is ejected by applying a negative voltage pulse and a positive voltage pulse as a pair to the piezoelectric element. The negative voltage pulse serves to expand the ink chamber, and the positive voltage pulse serves to contract the ink chamber. Accordingly, as illustrated in FIG. 11A, ink is ejected to the pixel having a gradation level of multiple droplets by repeatedly applying the pulse pair for the number of times corresponding to the number of the droplets. However, when the ink droplets are ejected, the ink amount of the first droplet tends to be smaller than the ink amount of the subsequent droplets. The reason for this is as follows. Namely, the ejection of the second and subsequent droplets is enhanced by the action of ejecting the preceding droplets such that the amount of one droplet becomes a predetermined value. However, the first droplet is not enhanced because there is no preceding droplet such that the amount of the first droplet is smaller than the predetermined value by the value corresponding to the enhancement. Because of this, as shown in FIG. 12 with solid line, the relationship between the number of droplets and the ink amount as discharged is not linear so that the characteristic curve excessively falls in the one-droplet region.

The prepulse is conventionally used to compensate this shortcoming. The prepulse is a short pulse inserted in advance of the first pulse set for the purpose of adjusting the amount of discharged ink as illustrated in FIG. 11B. By inserting the prepulse, the ink amount of the first droplet as ejected can be increased as illustrated in FIG. 12 with dotted line, and thereby the linearity in the relationship between the number of droplets and the ink amount as discharged can be improved.

In the case of the present embodiment, while compromising the linearity in the relationship between the number of droplets and the ink amount as discharged, the density of a lighter image portion represented by one-droplet pixels is lowered by increasing the voltage applied to the piezoelectric element in the block 230 having nozzles misaligned with periodic pitch displacements, and at the same time decreasing the pulse width of the prepulse or making no use of the prepulse.

Figure 13:
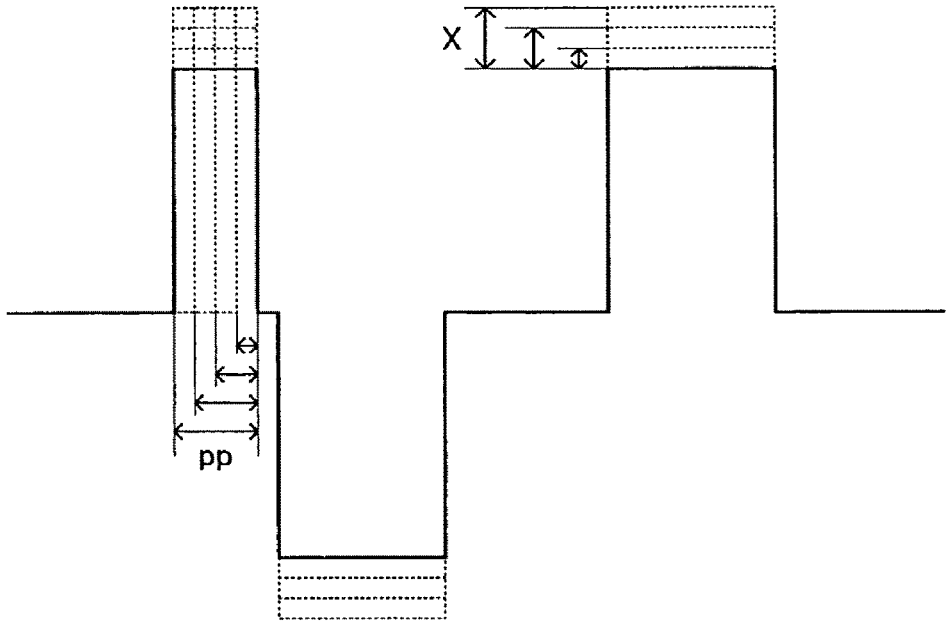
FIG. 13 is a view for explaining adjustment of the voltage pulse to be applied to the piezoelectric element in accordance with the embodiment of the present invention.

Next, the method of controlling the ink ejection will be specifically explained. FIG. 13 is a view for explaining adjustment of the voltage pulse to be applied to the piezoelectric element. The blocks 230 having nozzles misaligned with periodic pitch displacements can be found only after manufacturing the ink jet head. Because of this, each block 230 is tested to determine which block has nozzles misaligned with periodic pitch displacements. For each of the determined blocks having nozzles misaligned with periodic pitch displacements, the increment value X by which the voltage pulse is increased is determined for the purpose of preventing the density unevenness in a darker image. The increment value X can be determined in accordance with the degree of misalignments, the degree of density unevenness and so forth. The increment value X can be "0" for the normal block 230 having nozzles arranged in their correct positions.

Also, the width pp of the prepulse is determined for the purpose of preventing density unevenness which occurs in a lighter image portion as a result of the adjustment of the voltage pulse. The width pp of the prepulse can be determined in accordance with the degree of the density unevenness, the increment value X of the voltage pulse and so forth. The width pp of the prepulse is not changed from the default value for the normal block 230 having nozzles arranged in their correct positions. No prepulse may be applied depending upon the degree of the density unevenness.

Incidentally, the increment value X of the voltage pulse and the width pp of the prepulse are determined individually for the applicable maximum number of droplets since the appropriate values thereof vary depending upon the darkest density, i.e., the maximum number of droplets. The maximum number of droplets to be ejected for a pixel is determined on the basis of paper properties such as the type of the print sheet, the quality of print images and so forth. The representations of the adjustment value are not limited to the increment value of the voltage pulse and the width pp of the prepulse.

The increment value X of the voltage pulse and the width pp of the prepulse are set up and stored as nonvolatile data in the adjustment value storing unit 170 of the control unit 100 in advance of shipping the ink jet printer 10. FIG. 14 shows examples of adjustment values stored in the adjustment value storing unit 170. In these examples, for each block, the increment value of the voltage pulse and the width of the prepulse are associated with the maximum number of droplets in a table. Particularly, in these examples, the maximum number of droplets can be set to a value from 4 to 7 in accordance with the paper properties.

Figure 16:
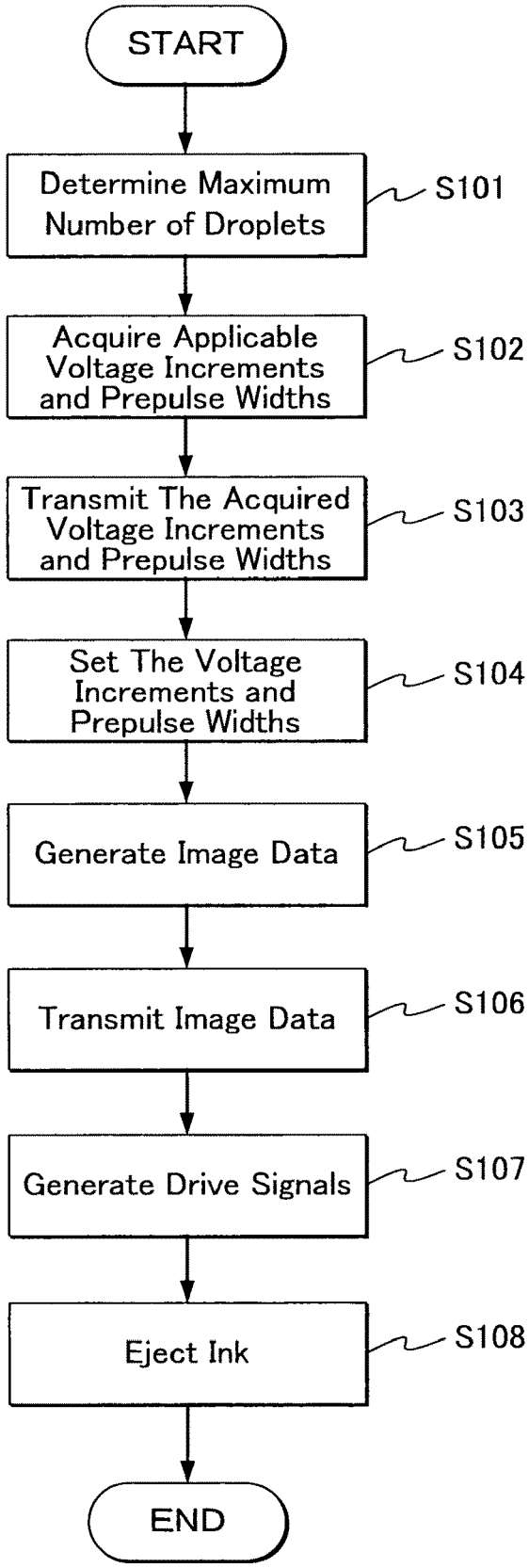
FIG. 16 is a flow chart for showing the process of the ink jet printer 10 when the user performs an actual print process in accordance with the embodiment of the present invention.

FIG. 16 is a flow chart for showing the process of the ink jet printer 10 when the user performs actual printing after shipping. In the print process, the CPU 110 determines the maximum number of droplets in step S101 by determining the type of the print sheet, the quality of print images and so forth on the basis of the print data as transmitted from the host computer and the settings accepted by the ink jet printer 10.

The adjustment values, i.e., the increment value of the voltage pulse and the width of the prepulse are acquired for each block 230 from the adjustment value storing unit 170 in correspondence with the maximum number of droplets as determined in step S102, followed by transmitting the increment value and the width of the prepulse for each block to the head driver 210 through the head image processing unit 150 in step S103.

When receiving the adjustment values for each block 230, in step S104, the adjustment value setting circuit 211 of the head driver 210 store the adjustment values for each block 230 in the register set 212. FIG. 15 shows examples of the adjustment values stored in the register set 212, i.e., examples of the adjustment values which are used when a print sheet is actually printed. As shown in the same figure, the increment value of the voltage pulse and the width of the prepulse are associated with each block in a table. In the case of this example, the table shown in FIG. 15 contains six pairs of the adjustment values which are extracted from the table shown in FIG. 14 when the maximum number of droplets is six.

The head image processing unit 150 then generates image data indicative of the number of droplets for each pixel on the basis of the given print data in step S105, and transmits the image data to the head unit 200 in step S106. The drive waveform generation circuit 213 of the head driver 210 generates drive signals corresponding to the number of droplets with reference to the increment value of the voltage pulse and the width of the prepulse stored in the register set 212 for each pixel in step S107. The ink jet head 220 ejects ink on the basis of the drive signals in step S108 in order to form a uniform image without density unevenness.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A printing apparatus comprising:

a line-type ink jet head having a plurality of blocks on each of which a set of ink ejection elements is arranged;

a drive signal generating unit configured to generate a drive voltage signal including a prepulse to be applied to the set of the ink ejection elements for each block, based on data indicating a number of times of ejecting ink to each pixel; and a first storage unit configured to store a drive signal adjustment value to adjust a set of a voltage value of the drive voltage signal and a width of the prepulse for each block, wherein the drive signal generating unit generates the drive voltage signal for each block, based on the drive signal adjustment value for each block read out from the first storage unit.

2. The printing apparatus as claimed in claim 1 wherein the drive signal adjustment values for each block is determined in accordance with a maximum number of times of ejecting ink to each pixel, the maximum number being variably determined in accordance with a type of print media.

3. The printing apparatus as claimed in claim 2 further comprising:

a second storage unit configured to store, as nonvolatile data, a drive signal adjustment values for each of plural values preliminarily set as the maximum number of times of ejecting ink, wherein the first storage unit stores the drive signal adjustment value for each block read from the second storage unit corresponding to one of the plural values of the maximum number of times to be currently used.

4. The printing apparatus as claimed in claim 1 wherein for a block which prints an image with a lighter density than other blocks when ink is ejected repeatedly for the maximum number of times by applying the same drive voltage to every block, the drive signal adjustment value is set up in order that the voltage value of the drive voltage signal is increased and that the width of the prepulse is reduced.

5. The printing apparatus as claimed in claim 4 wherein each block comprises two units joined together in order that the ink ejection elements thereof are arranged in a line direction.

6. The printing apparatus as claimed in claim 4 wherein each block comprises a single unit on which two series of the ink ejection elements thereof are arranged in a line direction.

7. The printing apparatus as claimed in claim 4 wherein the ink ejection elements on the block are misaligned with periodic displacements in a line direction.

8. A method of performing a print process by a printing apparatus provided with a line-type ink jet head having a plurality of blocks on each of which a set of ink ejection elements is arranged, the set of ejection elements being driven by a drive voltage signal including a prepulse, based on data indicating a number of times of ejecting ink to each pixel, the method comprising:

a step of storing a drive signal adjustment values value to adjust a set of a voltage value of the drive voltage signal and a width of the prepulse for each block; and a step of generating the drive voltage signal for each block, based on the drive signal adjustment value for each block read out.

* * * * *